US006709151B2

(12) United States Patent
Schmidt

(10) Patent No.: US 6,709,151 B2
(45) Date of Patent: Mar. 23, 2004

(54) MIXING DEVICE FOR MIXING LIQUID, FLOWABLE OR POWDERY MATERIALS

(75) Inventor: Gerd-Ulrich Schmidt, Hamm (DE)

(73) Assignee: Hauschild & Co. KG, Hamm (DE)

( * ) Notice: Subject to any disclaimer, the term of this patent is extended or adjusted under 35 U.S.C. 154(b) by 0 days.

(21) Appl. No.: 10/233,661

(22) Filed: Sep. 4, 2002

(65) Prior Publication Data

US 2003/0067838 A1 Apr. 10, 2003

(51) Int. Cl.[7] ..... B01F 9/22
(52) U.S. Cl. ..... 366/219; 366/217
(58) Field of Search ..... 366/208–211, 213–217, 366/219; 494/31, 33

(56) References Cited

U.S. PATENT DOCUMENTS

| | | | | |
|---|---|---|---|---|
| 749,104 | A | * | 1/1904 | Schoenefeldt |
| 3,679,184 | A | * | 7/1972 | Woodham et al. |
| 3,778,033 | A | * | 12/1973 | Pullman |
| 3,880,408 | A | * | 4/1975 | Karjalainen |
| 4,235,553 | A | * | 11/1980 | Gall |
| 4,497,581 | A | * | 2/1985 | Miller |
| 4,586,292 | A | * | 5/1986 | Carroll et al. |
| 4,728,197 | A | * | 3/1988 | Reinhard |
| 5,167,448 | A | * | 12/1992 | Herold et al. |
| 5,352,037 | A | * | 10/1994 | Jouvin |
| 5,551,779 | A | * | 9/1996 | Gantner et al. |
| 5,746,510 | A | * | 5/1998 | Mark et al. |
| 6,099,160 | A | | 8/2000 | Flackett |
| 6,361,486 | B1 | * | 3/2002 | Gordon |
| 2002/0172091 | A1 | * | 11/2002 | Hatekeyama ..... 366/144 |

FOREIGN PATENT DOCUMENTS

| | | | |
|---|---|---|---|
| JP | 63-310629 | * | 12/1988 |
| JP | 10-43568 | * | 2/1998 |
| JP | 2000-246081 | * | 9/2000 |
| JP | 2000-246082 | * | 9/2000 |
| JP | 2000-271465 | * | 10/2000 |
| JP | 2001-246236 | * | 9/2001 |
| JP | 2001-276592 | * | 10/2001 |
| JP | 2002-85953 | * | 3/2002 |
| JP | 2003-71264 | * | 3/2003 |

* cited by examiner

*Primary Examiner*—Charles E. Cooley

(57) ABSTRACT

A mixing device for mixing liquid, flowable or powdery materials comprises a pivoted first component, with a second component pivoted on the first component, with a drive mechanism for generating a rotational movement of the first component, and with a reversing device for transmitting and reversing a rotational movement of the first component to the second component, in such a way that the direction of rotation of the first component is opposite to the direction of rotation of the second component, the reversing device having at least one axial reversing element and at least one radial reversing element which are operatively connected to one another and with the frame and the second component via a flexible belt element.

10 Claims, 2 Drawing Sheets

MIXING DEVICE FOR MIXING LIQUID, FLOWABLE OR POWDERY MATERIALS

FIELD OF THE INVENTION

The present invention relates to a mixing device for mixing liquid, flowable or powdery materials, having a pivoted first component with a second component pivoted on the first component, with a drive mechanism for generating a rotational movement of the first component and with a reversing device for transmitting and reversing a rotational movement of the first component to the second component in such a way that a direction of rotation of the first component is opposite to the direction of rotation of the second component.

BACKGROUND OF THE INVENTION

A mixing device of this type for mixing pastes with pastes, pastes with powders or powders with powders, etc., is known from the prior art. Typical fields of application of such mixing devices from the prior art are for mixing sealing compounds and coating compounds (for example, silicones, polyurethanes and acrylates), varnishes, printing inks and pigments as well as for mixing one, two or multicomponent products in liquid or paste form.

Mixing devices of this type from the prior art have a compact form, are partially mobile and can be used at various locations. In addition, the mixing devices are, without exception, only suitable for substance amounts of between 5 g and 300 g. Larger amounts can not be processed with the mixing devices of the aforementioned type. One reason for this is that the reversal of the direction of rotation, i.e. the initiation of a rotational movement in opposite direction of the two pivoted components takes place via a shaft articulation. Due to the field of application relevant for the prior art, the mixing devices must be usable, for example, in dental practices, dental laboratories and the like. Therefore, the mixing devices are restricted to a specific degree with respect to their size, their weight and thus also with respect to their shaft articulation. If the mixing device of the prior art were to be constructed for larger processing amounts, this would result therein that too large a force action would be exerted on the shaft articulations available for such mixing devices, which would quickly destroy the said devices. The selection of larger shaft articulations would, in turn, result in very large mixing devices which would, for this reason, not be suitable for all applications.

A further disadvantage associated with the incorporation of shaft articulations is that a setting angle between the first component and the second component can only be changed by 8 degrees. However, the setting angle has an effect on the mixing device. For this reason, only a limited effect on the mixing action can be exerted by the limited setting angle.

Moreover, a mixing device of the prior art also has the disadvantage that a speed regulation of the speed of the first component and the second component could only be carried out at a very high cost.

SUMMARY OF THE INVENTION

It is desirable to develop a mixing device for mixing liquid, flowable or powdery materials of the aforementioned type in such a way that it is suitable for almost any processing amounts desired, independent of its size, and that the mixing action can be easily influenced dependent on the materials to be mixed.

According to the invention, the reversing device has at least one axial reversing element and at least one radial reversing element which are operatively connected with one another and with the drive mechanism and the second component via a flexible belt element.

By means of the design of the reversing device according to the invention, it is possible to permanently and reliably perform a reversal of a rotational movement on the second component, even with relatively large weights. The individual components can be robust and varied in their arrangement, as required, in order to absorb almost any forces without interrupting the operational function. Furthermore, by arranging the individual components of the reversing device appropriately vis-à-vis one another and by selecting their respective configuration, it is possible to vary the speeds of the first and the second component and thus the relative speeds to one another within the scope of simple physical considerations.

In addition, by arranging the individual components of the reversing device appropriately, it is possible to set the setting angle between the first component and the second component almost anywhere between 0 and 90° and to thus exert influence on the mixing action to be achieved.

Other aspects, features and advantages of the present invention will become apparent to those of ordinary skill in the art upon review of the following description of specific embodiments of the invention in conjunction with the accompanying figures.

BRIEF DESCRIPTION OF THE DRAWINGS

An embodiment of the present invention is described in greater detail with reference to the drawings, showing.

DETAILED DESCRIPTION OF THE PREFERRED EMBODIMENTS

Figure 1:
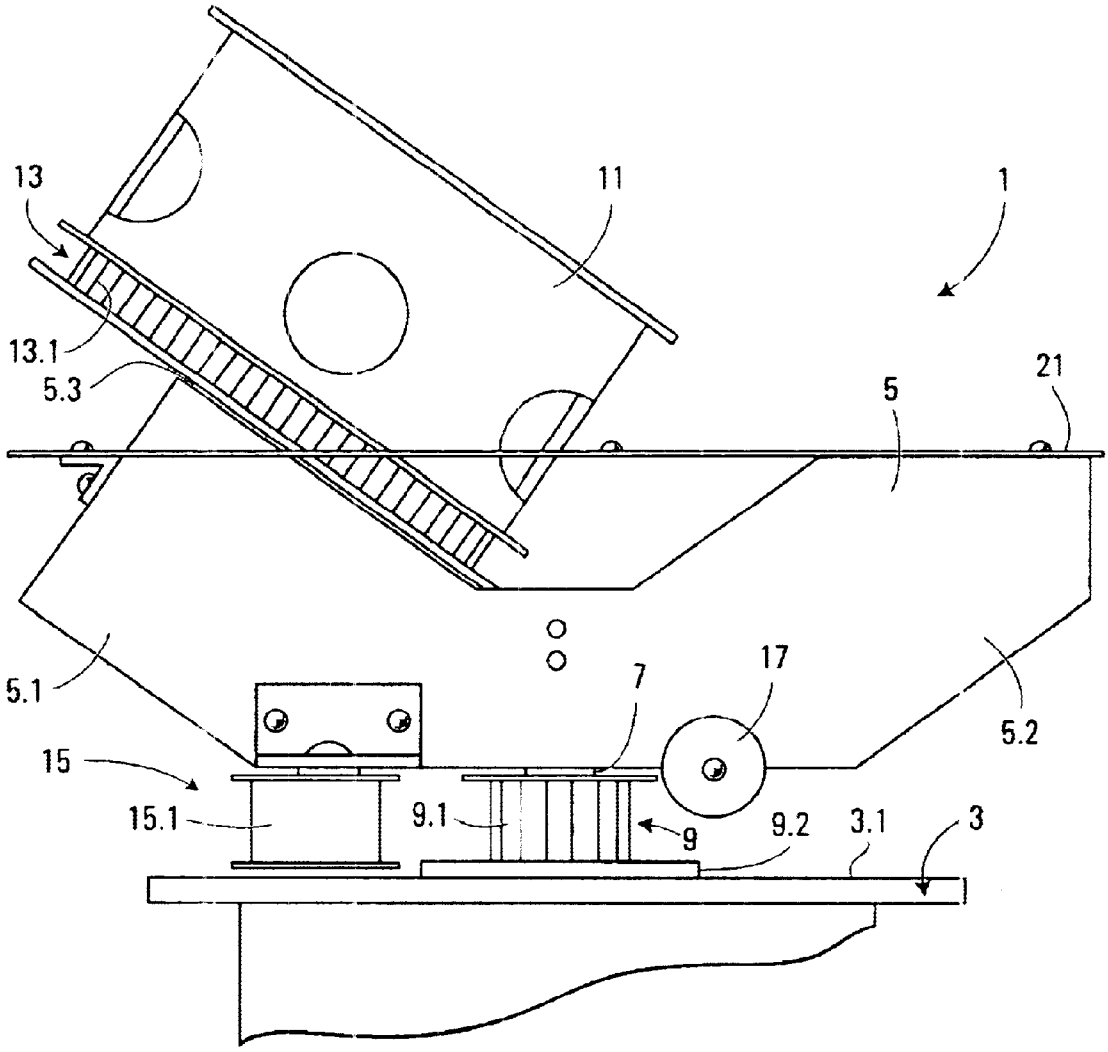
FIG. 1 a schematic side view of a first and second component according to the present invention.

The upper region of a mixing device 1 is schematically illustrated in FIG. 1 in a side view. A first component 5 in the form of a swivel arm is pivoted on a frame 3 and has a center of rotation D1. The swivel arm 5 is securely fastened to a shaft 7 of a drive mechanism (not shown) that can be integrated in the frame 3. The center of rotation of the shaft 7 coincides with the center of rotation D1 and is also referred to as center of rotation D1 in the following.

A V-belt pulley 9 is securely fastened to the frame 3 on a surface 3.1 opposite the swivel arm 5. The V-belt pulley 9 has a pass-through opening (not shown) for the shaft 7 and is arranged concentrically to the center of rotation D1 of the shaft 7 with a radial effective area 9.1 having wedge-shaped recesses. The V-belt pulley 9 is firmly secured to the surface 3.1 by screwing a base surface 9.2 and the frame 3 together. However, any other fastening means known from the prior art can also be used for securing it in position.

The swivel arm 5 can have any basic form desired. In the present embodiment, the swivel arm 5 has two sides 5.1 and 5.2. The side 5.1 extends in a vertical plane through the center of rotation D1 with a main axis at an angle, the so-called setting angle, between 0 and 90° radially to the center of rotation D1 of the shaft 7. A second component 11 is pivoted to a surface 5.3 of the side 5.1 that is angled accordingly and directed at a right angle to the vertical plane and has a center of rotation D2.

The second component 11 is in the form of a mixing vessel for holding the material to be mixed. An angle correlation between the center of rotation D1 of the first component 5 and the center of rotation D2 of the second component 11 is produced due to the position of the angle of side 5.1. The periphery of the second component 11 is in the form of a V-belt pulley 13 at the base, i.e. on the end of the second component 11 which is directed opposite the surface 5.3 of side 5.1. and thus securely connected with the second component 11. The V-belt pulley 13 has a radial effective area 13, concentric to the center of rotation D2, with wedge-shaped recesses.

A first axial reversing element 15, which is pivoted on the swivel arm 5, is arranged on the swivel arm 5 on the side of side 5.1. In the present embodiment, the center of rotation of the first reversing element 15 extends parallel to the center of rotation D1. The first reversing element has a radial smooth effective area 15.1, concentric to its center of rotation, which lies in a horizontal plane with the effective area 9.1 of the V-belt pulley 9. In FIG. 1, a second axial reversing element 15 which is configured exactly the same as the first axial reversing element 15 and is in the same relation to the V-belt pulley 9 and its effective area 9.1 is situated behind the first axial reversing element 15 (not visible). The two reversing elements 15 are arranged symmetrically to the V-belt pulley 9. In a top view, an imaginary connection between the center of rotation of the two reversing elements 15 and the center of rotation D1 represent an equilateral triangle, whereby the imaginary connection between the two centers of rotation of the reversing elements 15 forms a base side of this triangle.

A radial reversing element 17 is also arranged on the lower side of the swivel arm 5 in the area of the side 5.2. The radial reversing element 17 has a center of rotation that is essentially horizontal in the present embodiment and a radial, smooth effective area concentric thereto. The radial effective area meets an imagined horizontal median plane of the effective area 9.1 of the V-belt pulley 9 at one point. A second axial reversing element 17 is situated directly behind the radial reversing element 17, on the other side of the swivel arm 5, in FIG. 1. This second axial reversing element 17 is also configured the same as the axial reversing element 17 shown and is in the same relation to the V-belt pulley 9 and its effective area 9.1. The two radial reversing elements 17 are symmetrical to the center of rotation D1.

Figure 2:
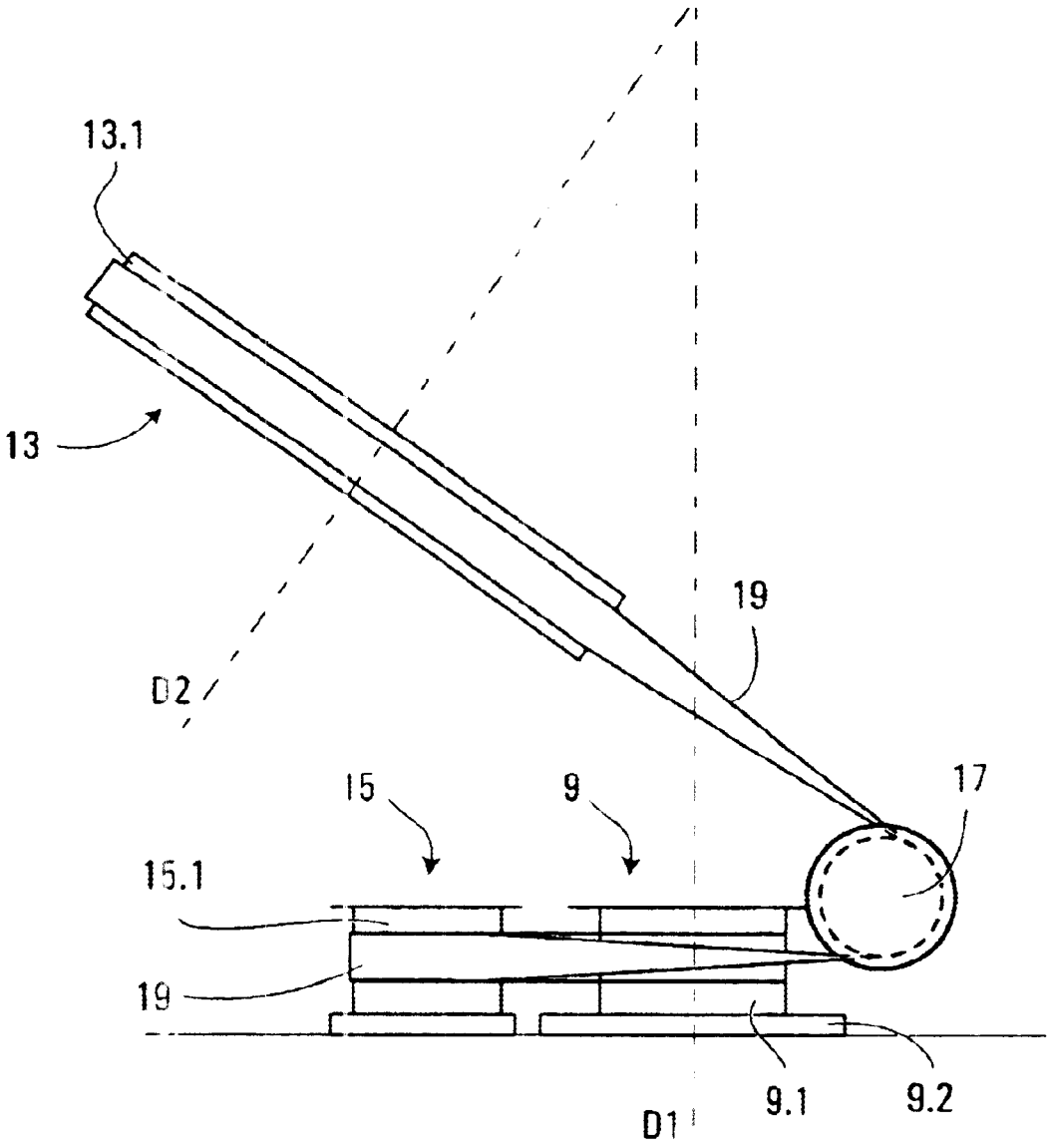
FIG. 2 a schematic side view of a reversing device according to the present invention.

The reversing mechanism is schematically illustrated in FIG. 2. The reversing mechanism is formed by a reversing device which, in the present embodiment, is formed by the first V-belt pulley 9, the two axial reversing elements 15, the two radial reversing elements 17 and the V-belt pulley 13. The aforementioned components of the reversing device are operatively interconnected via a flexible belt element 19 in the form of a V-belt. The endless V-belt 19 engages with its wedges in the recesses of the effective area 9.1 of the V-belt pulley 9, extends with its smooth underside about a partial periphery of the effective area 15.1 of the two axial reversing elements 15 and, also with its smooth side, about a partial periphery of the effective area 17.1 of the radial reversing elements 17 and finally with its wedge side about a partial periphery of the effective area 13.1 of the V-belt pulley 13. When the swivel arm 5 is turned about the center of rotation D1, the rotational movement is transmitted via the reversing device to the second component 11, the mixing vessel, in an opposite rotational movement.

The centers of rotation D1 and D2 in their angle correlation to one another and the diameter of the components of the reversing device are shown in FIG 2. By appropriately selecting the angle correlation between D1 and D2 and the diameters, various speeds can be set, depending on the material to be mixed, without changing the basic structural principle. The speed of the first component 5 vis-à-vis the second component 11 is regularly reduced with the described reversing device according to the present invention. However, theoretically, it is also possible to construct the reversing device in such a way that a step-up gearing is also possible in some cases. It is also possible that the reversing device have more than two axial and/or radial reversing elements 15, 17. Further reversing devices can also be provided between the axial reversing devices 15 and the radial reversing devices 17 and between the radial reversing devices 17 and the V-belt pulley 13, the effective areas of said reversing devices assuming angular positions between those of the effective areas 15.1, 17.1 and 13.1, in order to support the V-belt 19 in a guiding manner.

A rotary plate 21 is arranged on the upper side of the swivel arm 5 (FIG. 1), said rotary plate 21 having an opening in which the first component 11, the mixing vessel, partially engages.

What is claimed is:

1. A mixing device for mixing liquid, flowable or powdery materials, having a first component pivoted on a frame, with a second component pivoted on the first component, with a drive mechanism for generating a rotational movement of the first component, and with a reversing device for transmitting and reversing a rotational movement of the first component to the second component, in such a way that the direction of rotation of the first component is opposite to the direction of rotation of the second component, characterized therein that the reversing device has at least one axial reversing element and at least one radial reversing element which are operatively connected to one another and with the frame and the second component via a flexible belt element and wherein said drive mechanism has a shaft to which a first V-belt pulley is concentrically arranged and securely fastened to the frame, whereby the flexible belt element is led about the first V-belt pulley, characterized therein that each axial reversing element lies with its horizontal median plane in a horizontal median plane of the first V-belt pulley.

2. Mixing device according to claim 1, characterized therein that the first component is a swivel arm.

3. Mixing device according to claim 1, characterized therein that the second component is a mixing vessel.

4. Mixing device according to claim 1, characterized therein that each axial reversing element is a belt pulley.

5. Mixing device according to claim 1, characterized therein that each radial reversing element is a belt pulley.

6. Mixing device according to claim 1, characterized therein that the second component has a second V-belt pulley securely connected with the second component.

7. Mixing device according to claim 6, characterized therein that the second V-belt pulley securely connected with the second component has an effective area that lies in a setting angle vis-à-vis the horizontal median plane of an effective area of the first V-belt pulley.

8. Mixing device according to claim 7, characterized therein that the flexible belt element is led in an endless manner about a partial periphery of the effective area of the first V-belt pulley, effective areas of the axial reversing elements, effective areas of the radial reversing elements and the effective area of the second V-belt pulley.

9. Mixing device according to claim 1, characterized therein that each radial reversing element is arranged relative to an axial reversing element and lies with a section of a peripheral effective area in the median plane of the first V-belt pulley.

10. Mixing device according to claim 1, characterized therein that the flexible belt element is a V-belt.

* * * * *